US008616483B2

(12) United States Patent
Cascio et al.

(10) Patent No.: US 8,616,483 B2
(45) Date of Patent: Dec. 31, 2013

(54) BEARING HOUSING

(75) Inventors: Russell Cascio, Brown Deer, WI (US); Justin Zunker, Port Washington, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 0 days.

(21) Appl. No.: 13/307,076

(22) Filed: Nov. 30, 2011

(65) Prior Publication Data

US 2012/0135812 A1 May 31, 2012

Related U.S. Application Data

(60) Provisional application No. 61/458,714, filed on Nov. 30, 2010.

(51) Int. Cl.
*B02C 4/02* (2006.01)

(52) U.S. Cl.
USPC ..... 241/286; 384/571

(58) Field of Classification Search
USPC ..... 464/178; 384/565, 571; 492/21, 47; 74/581, 594; 241/285.1, 286, 290
See application file for complete search history.

(56) References Cited

U.S. PATENT DOCUMENTS

| | | | | |
|---|---|---|---|---|
| 3,262,335 | A * | 7/1966 | Heinlein et al. | 74/581 |
| 4,763,845 | A | 8/1988 | Guggenheimer et al. | |
| 5,441,206 | A | 8/1995 | Schade et al. | |
| 5,649,889 | A * | 7/1997 | Warner, III | 492/47 X |
| 7,210,853 | B2 * | 5/2007 | Leimann | 384/571 |
| 8,020,800 | B2 | 9/2011 | Potts | |

FOREIGN PATENT DOCUMENTS

| | | |
|---|---|---|
| WO | 99/54049 | 10/1999 |
| WO | 2004/018106 | 3/2004 |

OTHER PUBLICATIONS

AU2011253632 Patent Examination Report No. 1 dated Aug. 18, 2013 (3 pages).

* cited by examiner

*Primary Examiner* — Gregory Binda
(74) *Attorney, Agent, or Firm* — Michael Best & Friedrich LLP

(57) ABSTRACT

A shaft support for a first rotating shaft and a second rotating shaft. The shaft support includes a housing, a first bearing, and a second bearing. The housing includes a first portion, a second portion, and a transition portion connecting the first portion and the second portion. The first bearing is coupled to the first portion. The first bearing rotatably supports the first shaft and resists at least a portion of a first radial load exerted on the first shaft. The second bearing is coupled to the second portion and rotatably supports the second shaft. At least a portion of the first radial load is transmitted to the transition portion from the first bearing.

21 Claims, 6 Drawing Sheets

BEARING HOUSING

BACKGROUND

The present invention relates to the field of mining machines, and particularly to a roll sizer for breaking apart and crushing mined material.

Conventional mining roll sizers include a pair of parallel counter-rotating roll assemblies positioned within a crushing chamber. The shafts are rotatably supported by bearings and include a series of picks arranged along the surface. The bearings on either end of the shaft are typically spherical bearings. As the roll assemblies rotate, the picks engage material that is fed into the crushing chamber, exerting a compressive force on the material and breaking the material apart until it is small enough to pass around the rolls. During normal operation, the material exerts a reaction force on the shafts in a direction that is oblique to a shaft axis. This is especially true if a piece of hard material, or tramp material is fed into the crushing chamber. These reaction forces increase a localized radial load on the bearings and increase bearing misalignment. This causes the bearings to wear at a faster rate, ultimately requiring more maintenance and more down time of the roll sizer.

SUMMARY

In one embodiment, the invention provides a shaft support including a housing and a first bearing. The housing includes a first portion, a second portion, and a transition portion coupling the first portion and the second portion. The first bearing is coupled to the first portion. The first bearing rotatably supports a first shaft and resists at least a portion of a radial load exerted on the first shaft. At least a portion of the first radial load is transmitted to the transition portion from the first bearing.

In another embodiment, the invention provides a shaft assembly including first and second generally parallel rotating shafts. The shaft assembly includes a housing, a first bearing, and a second bearing. The housing includes a first portion, a second portion, and a transition portion connecting the first portion and the second portion. The first bearing is coupled to the first portion. The first bearing rotatably supports the first shaft and resists at least a portion of a first radial load exerted on the first shaft. At least a portion of the first radial load is transmitted to the transition portion from the first bearing. The second bearing is coupled to the second portion, and the second bearing rotatably supports the second shaft.

In yet another embodiment, the invention provides a shaft support for a rotating shaft. The shaft support includes a housing, a bearing rotatably supporting the shaft and resisting at least a portion of a first radial load exerted on the shaft, and a means for transmitting at least a portion of the radial load exerted on the shaft from the bearing to the housing. The bearing is coupled to the housing.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof Unless specified or limited otherwise, the terms "mounted," "connected," "supported," and "coupled" and variations thereof are used broadly and encompass both direct and indirect mountings, connections, supports, and couplings.

Figure 1:
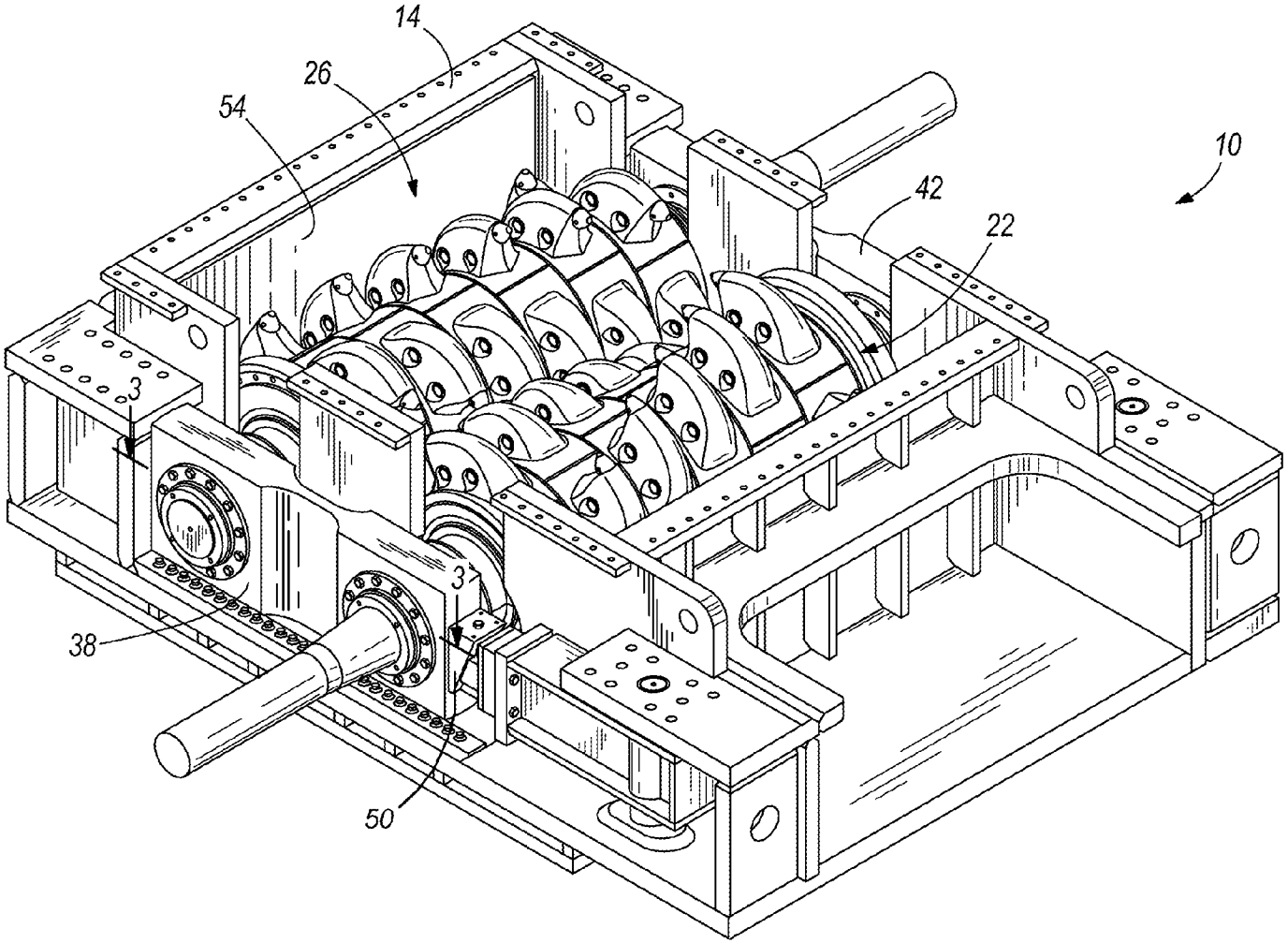
FIG. 1 is a perspective view of a roll sizer according to one embodiment of the invention.

FIG. 1 illustrates a mining roll sizer 10. The roll sizer 10 includes a frame 14, a first roll assembly 22, a second roll assembly 26, a first shaft support 38, a second shaft support 42, and a retaining wedge 50. The frame 14 defines an interior chamber 54. In one embodiment the interior chamber 54 has a rectangular shape. The first roll assembly 22 and the second roll assembly 26 are positioned substantially within the interior chamber 54 and are parallel to one another.

Figure 2:
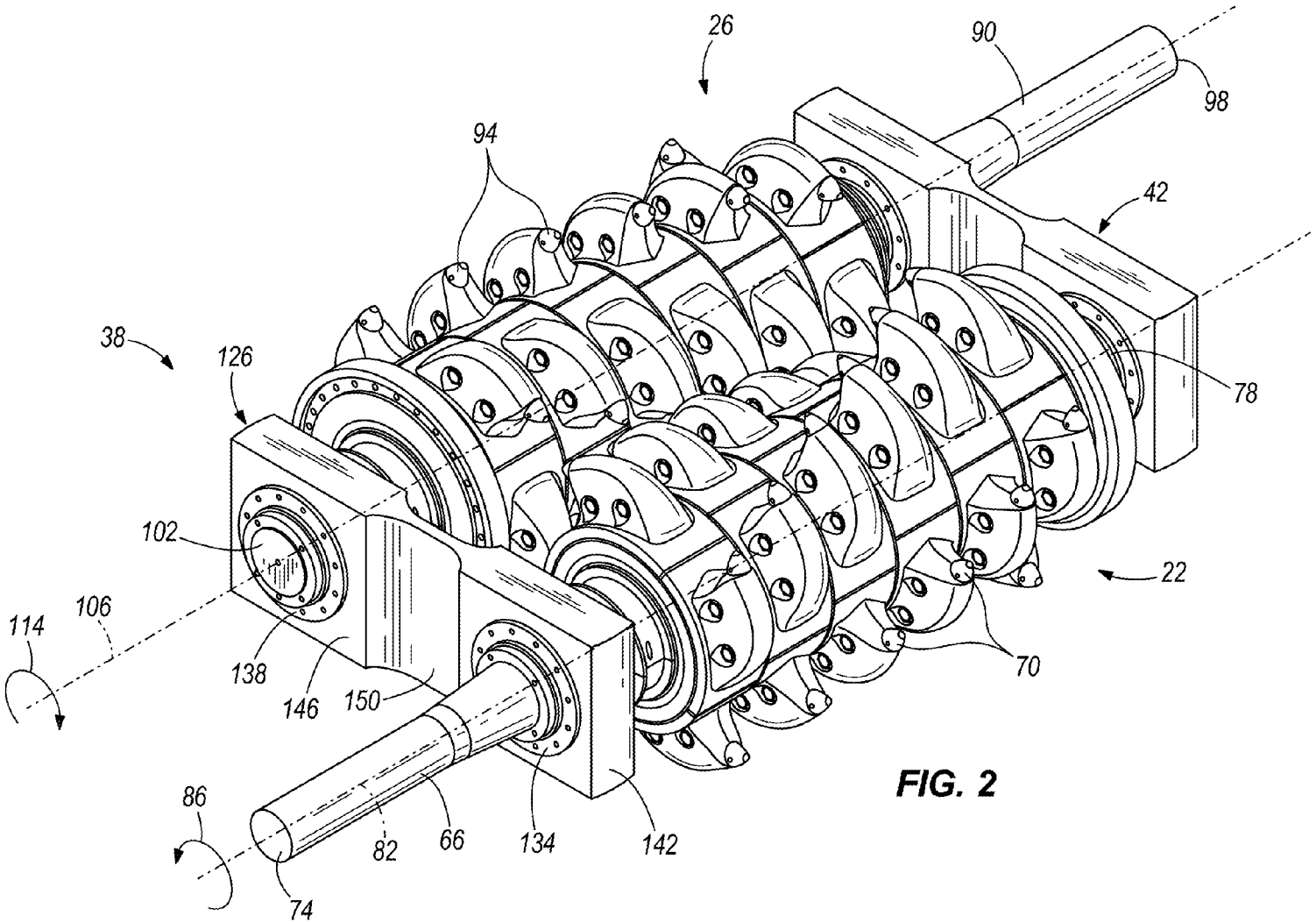
FIG. 2 is a perspective view of roll assemblies and shaft supports of the roll sizer of FIG. 1.

As shown in FIG. 2, the first roll assembly 22 includes a first shaft 66 and a plurality of first picks 70 coupled to the first shaft 66. The first shaft 66 includes a drive end 74 and a support end 78 opposite the drive end 74. The first shaft 66 defines a first axis 82 between the drive end 74 and the support end 78. The drive end 74 is coupled to a motor (not shown) for rotating the first roll assembly 22 in a first direction of rotation 86. The first picks 70 are located within the interior chamber 54 and are oriented to point in the first direction of rotation 86.

The second roll assembly 26 includes a second shaft 90 and a plurality of second picks 94 coupled to the second shaft 90. The second shaft 90 includes a drive end 98 and a support end 102 opposite the drive end 98. The second shaft 90 defines a second axis 106 between the drive end 98 and the support end 102. As used herein, the term "radial" or variants thereof refer to a direction that is perpendicular to at least one of the first axis 82 and the second axis 106. As used herein, the term "axial" or variants thereof refer to a direction that is parallel to at least one of the first axis 82 and the second axis 106. The drive end 98 of the second shaft 90 is coupled to a motor (not shown) for rotating the second shaft 90 in a second direction of rotation 114. In the illustrated embodiment, the first shaft 66 and the second shaft 90 are counter-rotating, such that the first second direction of rotation 114 is opposite the first direction of rotation 86. The second picks 94 are located within the interior chamber 54 and are oriented to point in the second direction of rotation 114.

In the illustrated embodiment, the first roll assembly 22 and the second roll assembly 26 are positioned in an anti-parallel configuration. That is, the drive end 74 of the first shaft 66 is proximate the support end 102 of the second shaft 90, while the drive end 98 of the second shaft 90 is proximate the support end 78 of the first shaft 66. In other embodiments, the roll assemblies 22, 26 may be positioned in a true parallel manner, such that the drive ends 74, 98 of both shafts 66, 90 are proximate one another and the support ends 78, 102 of both shafts 66, 90 are proximate one another.

As shown in FIG. 2, the drive end 74 of the first shaft 66 and the support end 102 of the second shaft 90 are supported by the first shaft support 38. Similarly, the support end 78 of the first shaft 66 and the drive end 98 of the second shaft 90 are supported by the second shaft support 42. Since the second shaft support 42 is substantially the same as the first shaft support 38, only differences between the two shaft supports will be described. Otherwise, the description of the first shaft support 38 also applies to the second shaft support 42.

Figure 3:
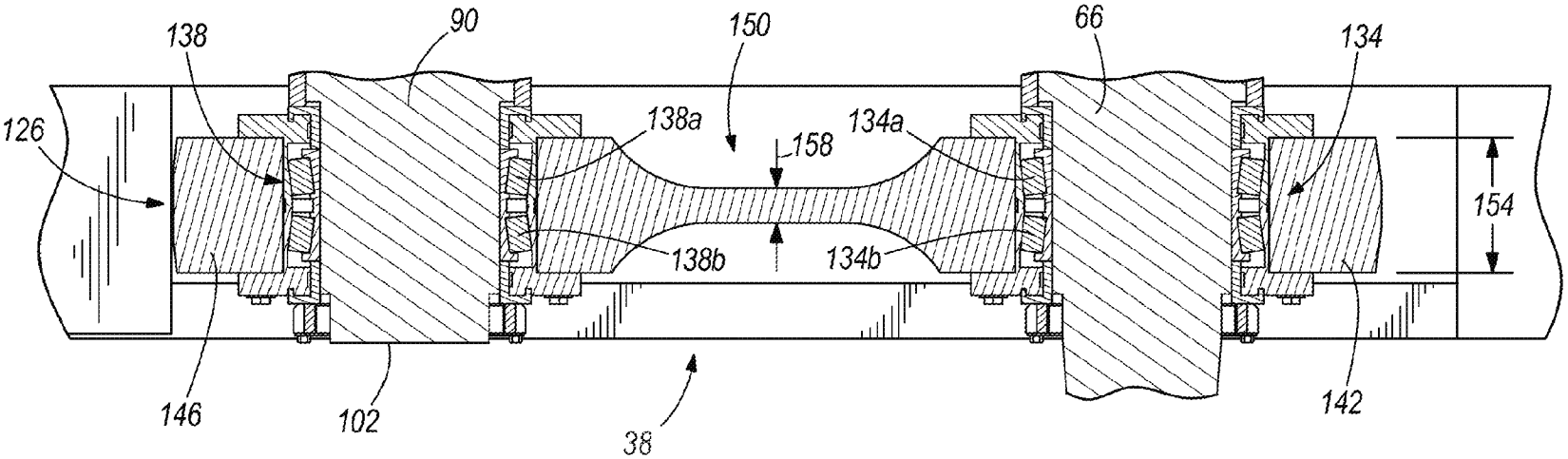
FIG. 3 is a section view of a first shaft support taken along line 3--3 in FIG. 1.

Referring to FIGS. 2 and 3, the first shaft support 38 includes a housing 126, a first bearing 134, and a second bearing 138. The housing 126 includes a first portion 142, a second portion 146, and a transition portion 150 between the first portion 142 and the second portion 146. The first shaft support 38 is secured in place by the retaining wedge 50 (FIG. 1) abutting the first portion 142. In the embodiment shown in FIG. 3, the first portion 142 and the second portion 146 have a first thickness 154, while the transition portion 150 has a second thickness 158 that is less than the first thickness 154. In other embodiments, the first portion 142 and the second portion 146 may have different thicknesses, both of which are greater than the second thickness 158.

Referring to FIG. 3, the first bearing 134 is coupled to the first portion 142 of the housing 126 and rotatably supports the first shaft 66, absorbing at least a portion of a radial load exerted on the first shaft 66. The second bearing 138 is coupled to the second portion 146 of the housing 126 and rotatably supports the second shaft 90, absorbing at least a portion of a radial load exerted on the second shaft 90. In the embodiment shown in FIG. 3, the first bearing 134 and the second bearing 138 are two-row, double outer race (TDO) tapered roller bearings. The first bearing 134 includes an inner bearing 134*a* and an outer bearing 134*b*. The second bearing 138 includes an inner bearing 138*a* and an outer bearing 138*b*. In other embodiments, twin single tapered roller bearings or another type of bearing may be used.

During operation of the roll sizer 10, the interior chamber 54 receives material from, for example, a conveyor (not shown). Pieces of the material are urged toward a position between the first roll assembly 22 and the second roll assembly 26, where the force of the picks 70, 94 converge and break apart the pieces to a desirable size. The material then falls between the first roll assembly 22 and the second roll assembly 26 and out of the interior chamber 54. As the picks 70, 94 engage the material, the material resists the force of the picks 70, 94. This creates reaction forces acting in a direction oblique to the first axis 82 and the second axis 106. The reaction force can be especially large if a highly dense material, or a tramp material, is inserted in the interior chamber 54. The reaction forces cause deflection of the shafts 66, 90 and concentrates the radial load on the inner bearings 134*a*, 138*a*.

When the first bearing 134 and the second bearing 138 experience an increase in radial loading, the smaller thickness 158 of the transition portion 150 provides a stress concentration such that the loading is transmitted to the housing and away from the bearings 134, 138. The reduced thickness of the transition portion 150 reduces the rigidity of the transition portion 150 relative to the first portion 142, allowing the housing 126 to be flexible. The stress concentration at least partially equalizes the radial loading between the inner bearings 134*a*, 138*a* and the outer bearings 134*b*, 138*b*, and reduces misalignment of the bearings 134, 138. This equalization reduces wear on the inner bearings 134*a*, 138*a* and improves the overall life of the first bearing 134 and the second bearing 138. The transition portion 150 having a thickness that is less than the first portion 142 and the second portion 146 (and therefore a lower rigidity) constitutes a means for transmitting radial load from the bearings 134, 138 to the housing 126.

Figure 4:
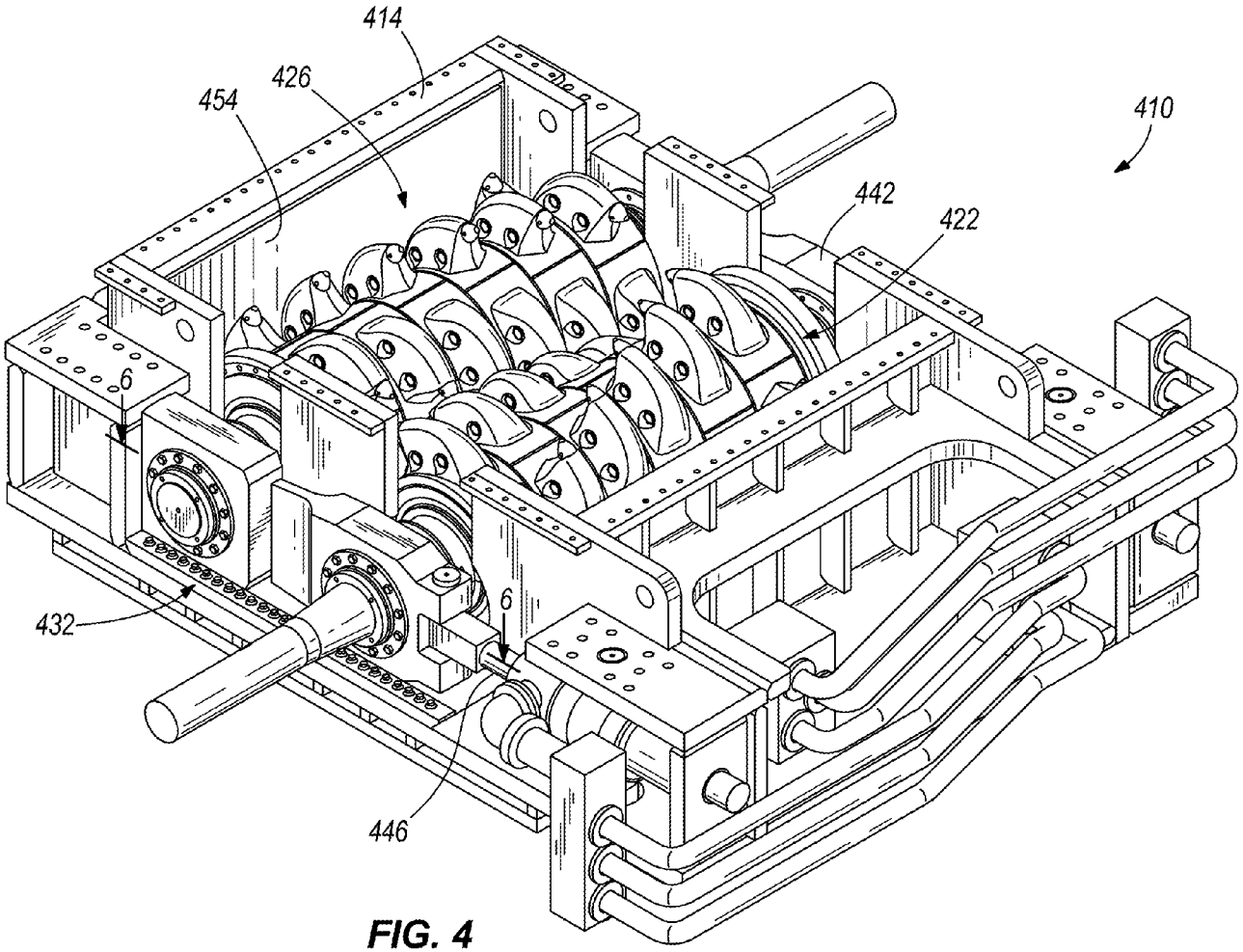
FIG. 4 is a perspective view of a roll sizer according to another embodiment of the invention.
Figure 5:
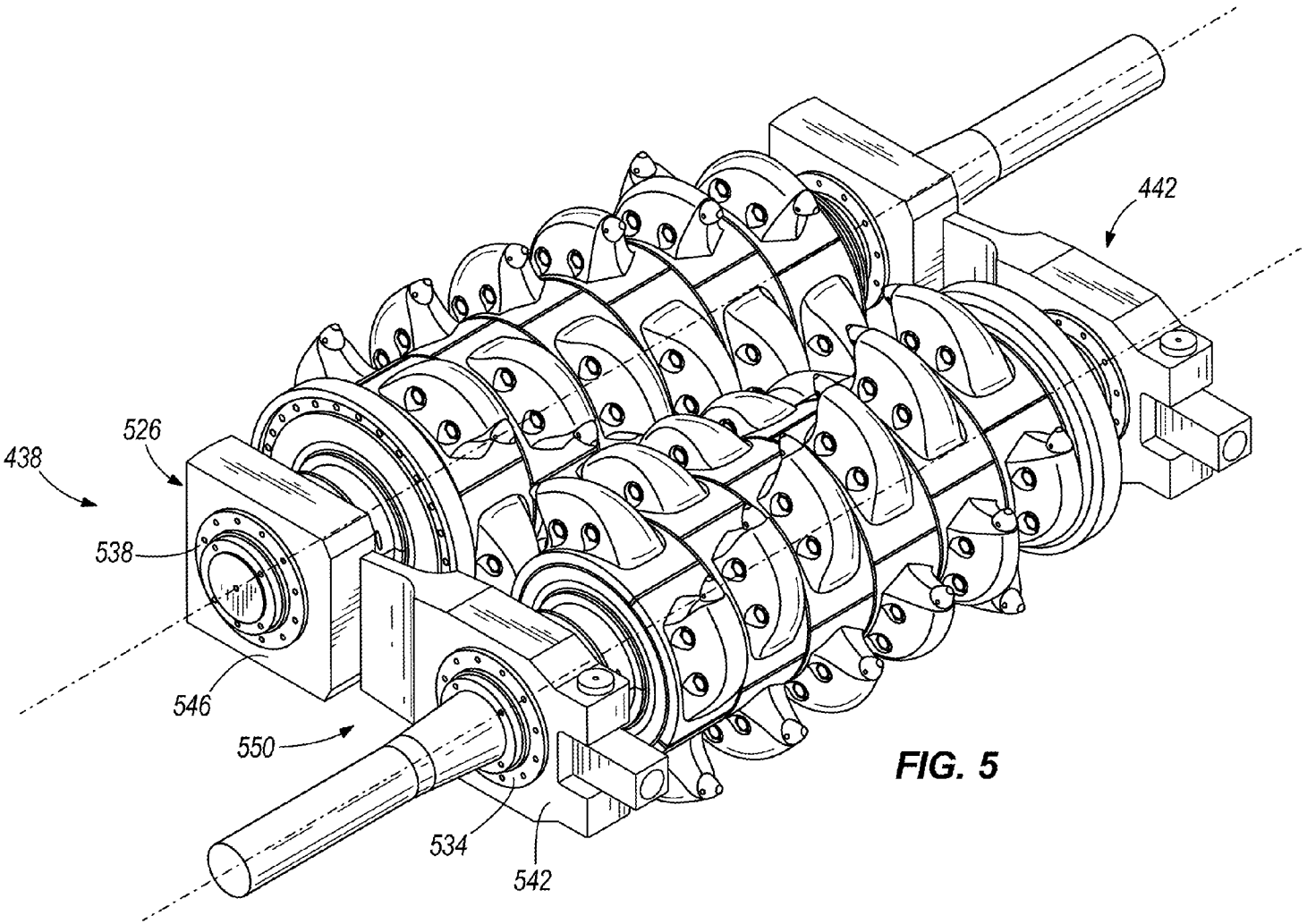
FIG. 5 is a perspective view of roll assemblies and shafts supports of the roll sizer of FIG. 4.
Figure 6:
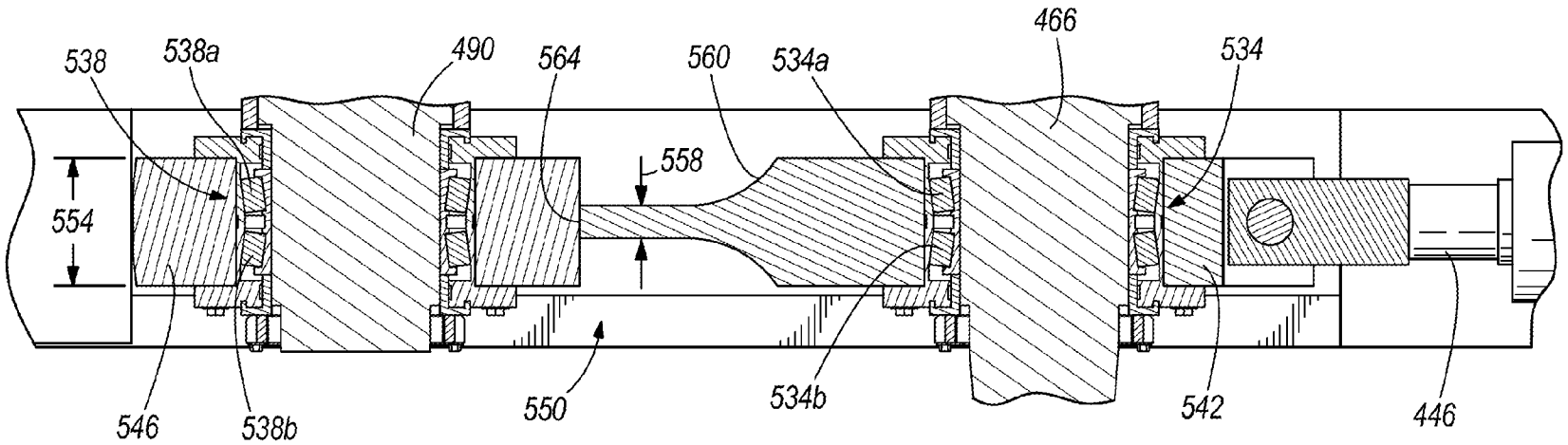
FIG. 6 is a section view of a first shaft support taken along line 6--6 of FIG. 4.

FIGS. 4-6 illustrate a roll sizer 410 according to another embodiment of the invention. The illustrated roll sizer 410 is similar to the roll sizer 10 described above with reference to FIGS. 1-3, and similar features have been given the same reference numbers, plus 400. Only differences between the roll sizer 410 and the roll sizer 10 are described in detail below. The roll sizer 410 includes a frame 414, a first roll assembly 422, a second roll assembly 426, a first shaft support 438, and a second shaft support 442, and an actuator 446. The actuator 446 moves the first roll assembly 422 away from the second roll assembly 426 in the event that reaction forces exerted on the roll assemblies 422, 426 exceed a permissible level.

Referring to FIGS. 5 and 6, the first shaft support 438 includes a housing 526, a first bearing 534, and a second bearing 538. The housing 526 includes a first portion 542, a second portion 546, and a transition portion 550. In the embodiment illustrated in FIG. 6, the first portion 542 and the second portion 546 have a first thickness 554, while the transition portion 550 has a second thickness 558 that is less than the first thickness 554. In other embodiments, the first portion 542 and the second portion 546 may have different thicknesses, both of which are greater than the second thickness 558.

As shown in FIG. 6, the transition portion 550 includes a first end 560 coupled to the first portion 542, and a second end 564 that is positioned away from the first end 560. The second end 564 is adapted to removably couple the first portion 542 and the second portion 546 abutting the second portion 546. In another embodiment (not shown), the coupling may be accomplished by forming a groove or slot in the second portion 546 and inserting the second end 564 of the transition portion 550 in the slot.

In the embodiment illustrated in FIGS. 4-6, the transition portion 550 is formed integrally with the first portion 542. In other embodiments, the transition portion 550 may be coupled to the first portion 542 in another manner, such as by welding, by an interlocking connection, a bolted joint, or any of various other methods. In still other embodiments, the transition portion 550 may be coupled to the second portion 546 instead of the first portion 542.

As described above regarding the embodiment illustrated in FIGS. 1-3, the transition portion 550 provides a stress concentration such that radial loading due to deflection of the shafts 466, 490 is transmitted from the bearings 534, 538 to the housing 526. This occurs when the second end 564 engages the second portion 546. The transition portion 550 also allows for flexure of the housing 526. The stress concentration at least partially equalizes the radial loading between the inner bearings 534*a*, 538*a* and the outer bearings 534*b*, 538*b* and reduces misalignment of the bearings 534, 538. This equalization reduces wear on the inner bearings 534*a*, 538*a* and improves the overall life of the first bearing 534 and the second bearing 538.

Thus, the invention provides, among other things, a bearing housing for a roll sizer. Various features and advantages of the invention are set forth in the following claims.

What is claimed is:

1. A shaft assembly comprising:

a first shaft including a first end, a second end, and a first axis defined therebetween, the first shaft rotatable about the first axis in a first direction;

a housing including a first portion, a second portion, and a transition portion coupling the first portion and the second portion, the first portion receiving the first end of the first shaft, the transition portion being tapered between the first portion and the second portion such that the transition portion has a smaller thickness than the first portion; and a first bearing coupled to the first portion, and rotatably supporting the first end of the first shaft, the first bearing resisting at least a portion of a radial load exerted on the first shaft, the first bearing including a first outer tapered roller bearing proximate the first end of the first shaft and a first inner tapered roller bearing positioned adjacent the first outer tapered roller bearing and away from the first end of the first shaft; and wherein at least a portion of the radial load is transmitted to the transition portion from the first inner tapered roller bearing.

2. The shaft assembly of claim 1, further comprising a second shaft spaced apart from the first shaft, the second shaft including a first end, second end, and a second axis defined therebetween, the second axis oriented generally parallel to the first axis, the second shaft rotatable about the second axis in a second direction opposite the first direction; and a second bearing coupled to the second portion of the housing and rotatably supporting the first end of the second shaft, the second bearing resisting at least a portion of the radial load exerted on the second shaft, the second bearing including a second outer tapered roller bearing proximate the first end of the second shaft and a second inner tapered roller bearing positioned adjacent the second outer tapered roller bearing and away from the first end of the second shaft.

3. The shaft assembly of claim 2, wherein deflection of the second shaft with respect to the first shaft causes a portion of the radial load to be transmitted to the transition portion from the second inner tapered roller bearing.

4. The shaft assembly of claim 1, wherein transmission of a portion of the first radial load at least partially equalizes the radial load between the inner bearing and the outer bearing.

5. The shaft assembly of claim 1, wherein the transition portion has a rigidity that is less than the first portion.

6. The shaft assembly of claim 1, wherein the transition portion removably couples the first portion and the second portion.

7. The shaft assembly of claim 1, wherein the transition portion is integrally formed with the first portion and the second portion.

8. A shaft assembly comprising:

a pair of generally parallel rotating shafts, each shaft including a first end, a second end, and an axis defined therebetween;

a housing including a first portion, a second portion, and a transition portion extending between the first portion and the second portion;

a first bearing coupled to the first portion, for rotatably supporting the one shaft and resisting at least a portion of a radial load exerted on the first shaft, the first bearing including a first outer tapered roller bearing proximate a first end of the one shaft and an first inner tapered roller bearing positioned adjacent the first outer tapered roller bearing and away from the first end of the one shaft, wherein deflection of the one shaft causes at least a portion of the radial load exerted on the first inner tapered roller bearing to be transmitted to the transition portion in order to reduce the difference between the radial load exerted on the first inner tapered roller bearing and the radial load exerted on the first outer tapered roller bearing; and a second bearing coupled to the second portion, for rotatably supporting the other shaft and resisting at least a portion of a radial load exerted on the other shaft, the second bearing including a second outer tapered roller bearing proximate the first end of the other shaft and a second inner tapered roller bearing positioned adjacent the outer tapered roller bearing and away from the first end of the other shaft, wherein deflection of the other shaft causes at least a portion of the radial load exerted on the second inner tapered roller bearing to be transmitted to the transition portion in order to reduce the difference between the radial load exerted on the second inner tapered roller bearing and the radial load exerted on the second outer tapered roller bearing.

9. The shaft assembly of claim 8, wherein transmission of a portion of the first radial load at least partially equalizes the radial load between the inner bearing and the outer bearing.

10. The shaft assembly of claim 8, wherein the first portion has a first thickness, and the transition portion has a second thickness that is less than the first thickness.

11. The shaft assembly of claim 8, wherein the transition portion has a rigidity that is less than the first portion.

12. The shaft assembly of claim 8, wherein the transition portion removably engages the second portion.

13. The shaft assembly of claim 8, wherein the transition portion is integrally formed with the first portion and the second portion.

14. A roll sizer comprising:

a roll assembly including a shaft and a plurality of picks supported on the shaft, the shaft including a first end, a second end, and an axis defined therebetween, the shaft rotatable about the axis, the picks configured to engage and break apart material that is fed into the roll sizer;

a housing;

a first bearing coupled to the housing, for rotatably supporting the shaft and resisting at least a portion of a first radial load exerted on the shaft due to the picks engaging the material, the first bearing including an outer tapered roller bearing and an inner tapered roller bearing, the outer tapered roller bearing positioned proximate the first end of the shaft, the inner tapered roller bearing positioned adjacent the outer tapered roller bearing and away from the first end of the shaft; and a means for transmitting at least a portion of the radial load on the shaft from the inner tapered roller bearing to the housing to reduce the difference between the load exerted on the inner tapered roller bearing and the load exerted on the outer tapered roller bearing.

15. The roll sizer of claim 14, wherein the means for transmitting at least partially equalizes the radial load between the inner bearing and the outer bearing.

16. The roll sizer of claim 14, the housing further including a first portion, a transition portion, and a second portion.

17. The roll sizer of claim 16, wherein the means for transmitting includes the transition portion having a thickness that is less than a thickness of the first portion.

18. The roll sizer of claim 16, wherein the transition portion has a rigidity that is less than the first portion.

19. The roll sizer of claim 16, wherein the transition portion is integrally formed with the first portion and the second portion.

20. The roll sizer of claim 16, wherein the transition portion removably couples the first portion and the second portion.

21. The roll sizer of claim 14, wherein the roll assembly is a first roll assembly and further comprising a second roll assembly including a second shaft and a plurality of picks supported on the second shaft, the second shaft including a first end, a second end, and a second axis defined therebetween, the second shaft rotatable about the second axis in a direction opposite the direction of rotation of the first shaft, the picks configured to engage and break apart material that is fed into the roll sizer; and a second bearing coupled to the housing for rotatably supporting the second shaft and resisting at least a portion of a radial load exerted on the second shaft due to the picks engaging the material, the second bearing including a second outer tapered roller bearing and a second inner tapered roller bearing, the second outer tapered roller bearing positioned proximate the first end of the second shaft, the second inner tapered roller bearing positioned adjacent the second outer tapered roller bearing and away from the first end of the second shaft, wherein the means for transmitting also transmits at least a portion of the radial load on the second shaft from the second inner tapered roller bearing to the housing to reduce the difference between the load exerted on the second inner tapered roller bearing and the load exerted on the second outer tapered roller bearing.

* * * * *

UNITED STATES PATENT AND TRADEMARK OFFICE

CERTIFICATE OF CORRECTION

PATENT NO. : 8,616,483 B2
APPLICATION NO. : 13/307076
DATED : December 31, 2013
INVENTOR(S) : Russell Cascio and Justin Zunker It is certified that error appears in the above-identified patent and that said Letters Patent is hereby corrected as shown below:

In the Claims:

| | |
|---|---|
| Column 5, claim 1, line 13: | delete the first instance "," |
| Column 5, claim 8, line 61: | delete the first instance "," |
| Column 6, claim 8, line 8: | delete the first instance "," |
| Column 6, claim 14, line 44: | delete the first instance "," |
| Column 6, claim 14, line 45: | delete the word "first" |

Signed and Sealed this
Twenty-ninth Day of April, 2014

Michelle K. Lee

Michelle K. Lee
*Deputy Director of the United States Patent and Trademark Office*